US007659464B1

(12) United States Patent
Kokodis

(10) Patent No.: US 7,659,464 B1
(45) Date of Patent: Feb. 9, 2010

(54) NECK FOR STRINGED MUSICAL INSTRUMENT

(76) Inventor: Victor Nickolas Kokodis, 9 Shenandoah Crescent, Wharton, NJ (US) 07885-2910

( * ) Notice: Subject to any disclaimer, the term of this patent is extended or adjusted under 35 U.S.C. 154(b) by 0 days.

(21) Appl. No.: 12/273,584

(22) Filed: Nov. 19, 2008

Related U.S. Application Data

(60) Provisional application No. 60/990,928, filed on Nov. 29, 2007.

(51) Int. Cl.
*G10D 3/00* (2006.01)

(52) U.S. Cl. ..... 84/293

(58) Field of Classification Search ..... 84/84, 84/293

See application file for complete search history.

(56) References Cited

U.S. PATENT DOCUMENTS

| | | | | | |
|---|---|---|---|---|---|
| 516,717 | A | * | 3/1894 | Anderberg | 84/293 |
| 518,869 | A | * | 4/1894 | Toye | 84/271 |
| 557,277 | A | * | 3/1896 | Kelly et al. | 84/267 |
| 586,032 | A | * | 7/1897 | Hartman | 84/295 |
| 977,127 | A | * | 11/1910 | Rengert et al. | 84/293 |
| 3,416,399 | A | * | 12/1968 | Baldoni | 84/293 |
| 4,079,652 | A | | 3/1978 | Gittler | |
| 4,145,948 | A | * | 3/1979 | Turner | 84/293 |
| 4,167,133 | A | * | 9/1979 | Adams, Jr. | 84/293 |
| 4,189,974 | A | * | 2/1980 | Martin et al. | 84/293 |
| 4,235,145 | A | * | 11/1980 | Adams, Jr. | 84/293 |
| 4,359,924 | A | * | 11/1982 | Brunet | 84/293 |
| 4,616,550 | A | * | 10/1986 | Lacroix et al. | 84/173 |
| 4,637,290 | A | * | 1/1987 | Grawi | 84/173 |
| 4,759,250 | A | | 7/1988 | Lieber | |
| 5,072,643 | A | * | 12/1991 | Murata | 84/293 |
| 5,239,908 | A | | 8/1993 | Attias | |
| 5,465,642 | A | * | 11/1995 | Goto | 84/293 |
| 5,753,837 | A | * | 5/1998 | Petillo et al. | 84/293 |
| 6,051,765 | A | * | 4/2000 | Regenberg et al. | 84/293 |
| 6,259,008 | B1 | * | 7/2001 | Eddinger et al. | 84/293 |
| 6,329,581 | B1 | * | 12/2001 | Negin | 84/293 |
| 6,376,756 | B1 | | 4/2002 | Beckmeier | |
| 6,787,688 | B2 | | 9/2004 | Harmos et al. | |
| 6,888,055 | B2 | | 5/2005 | Smith et al. | |
| 7,285,708 | B1 | | 10/2007 | Beckmeier | |
| 7,507,887 | B1 | * | 3/2009 | Blanchard | 84/293 |

* cited by examiner

*Primary Examiner*—Jeffrey Donels
*Assistant Examiner*—Robert W Horn
(74) *Attorney, Agent, or Firm*—William Eshelman

(57) ABSTRACT

A neck for a stringed musical instrument may include a generally longitudinal center support member with a fingerboard fixed thereto. The center support member may be fixed at one end to a string mounting member and fixed at an opposite end to a body of the stringed musical instrument. A generally longitudinal tension adjustment member may be fixed at one end to the string mounting member and fixed at an opposite end to the body of the stringed musical instrument. The tension adjustment member may be adjustable to vary stress on the neck. A generally longitudinal spatial volume may be located between the center support member and the tension adjustment member. A majority of the spatial volume may comprise ambient air.

19 Claims, 12 Drawing Sheets

NECK FOR STRINGED MUSICAL INSTRUMENT

CROSS-REFERENCE TO RELATED APPLICATIONS

This application claims the benefit under 35 USC 119(e) of U.S. provisional patent application No. 60/990,928 filed Nov. 29, 2007, which application is hereby incorporated by reference.

FIELD OF THE INVENTION

The invention relates in general to stringed musical instruments, and, in particular, to necks for stringed musical instruments.

BACKGROUND OF THE INVENTION

Stringed musical instruments may produce sound by plucking or strumming the attached strings, which may be stretched between the body and the neck of the instrument. The body may be used to amplify and sustain the string vibrations. The neck of the instrument may be used to support the string tension and to allow the user to change the pitch of the string by pressing along the length of the neck's fingerboard to form the different notes. Typically, the neck may not be considered the primary contributing component of the instrument's sound.

Stringed instrument necks may be constructed from materials such as wood or plastic, and may be reinforced with materials such as carbon fiber or metal alloys, to maintain the rigidity required. Neck designs may include a truss rod that may allow the user to adjust the amount the neck deforms or bows. String tension and environmental factors, such as humidity and temperature, may cause the neck to deform or bow.

Prior art necks may have a cross-sectional profile resembling a semi-circle. The fret board may be located on the top portion of the semi-circle and may be where the fingering from the user occurs. The rounded portion of the semi-circle may lie underneath the fret board and may act as a means to support the player's hand. A number of specialized apparatus may be required to fabricate these prior art semi-circular necks. Also, if the neck is constructed of wood, large amounts of material may be wasted due to the shaping required to form the semi-circular pattern. Fabricating these types of necks requires a highly specialized work force that is experienced in detailed wood work.

Prior art necks were generally designed to act as a unitary member within the musical instrument. In such a design, the main structure of the neck and the fingerboard may be fastened together, or may be fabricated from a single piece of material. The end result may be a neck structure that is relatively massive. A large vibration force may be needed to excite the neck enough to produce an audible difference in the overall instrument's sound. Such a large force is typically not achievable from the instrument.

Furthermore, removable or bolt-on necks may have a flat section on the bottom side, referred to as the neck heal. The neck heal may fit into a mating cut-out or pocket in the instrument's body, and may be held in place with some type of fastener. This method of attaching a neck to a body may limit the design alternatives for the body, due to the required attachment geometry. The neck and body mating requirement may require that the instrument have sharp edges in the area of the neck to the body joint. The neck and body mating requirement may further require an overall thickness of the instrument at the neck to the body joint that makes playing the instrument in that area uncomfortable.

One solution to the neck and body mating requirement has been to construct an instrument with a neck that is permanently attached to the body's structure. Examples of permanent neck attachments include a glued-in neck, and a neck-thru design wherein a single central piece of wood extends from the bottom of the body and continues to form the neck structure. Two pieces of wood or other material may be glued to either side of the central piece to form the body's wings. This method may resolve the issue of playing comfort by not requiring the pocket geometry of a bolt on design, but may have other disadvantages. One such disadvantage is the permanent nature of the neck to body joint. It may be difficult to replace the neck without damaging the whole instrument.

When tuning the strings of a musical instrument, a compression force may be applied to the neck that may tend to bow the neck upwardly. The upward bow in the neck may cause the distance between the strings and the fingerboard to increase. The increased distance between the strings and the fingerboard may affect the ease of playing the instrument, because more force is required to push the strings down onto the fingerboard. It also may cause the instrument to play the note out of tune, because the string may be stretched further when the string is pushed down onto the fingerboard.

Prior art necks have alleviated neck bowing by inserting a truss rod into a channel formed down the center of the neck's structure. The truss rod may comprise a rod threaded on one end, whereby tightening of a nut produces a force on the neck that opposes the bowing force of the strings. The truss rod may provide only a downward force to counter the string pull. Other prior art neck designs comprise two rods arranged one on top of the other, whereby shortening the length of one of the rods (by tightening a nut, for example) causes the rod assembly to bend in the direction of the shortest rod. This bending may cause a force opposite to the string force to be applied to the neck.

A disadvantage of the single truss rod and the two rods arranged one on top of the other is the inconsistency of the compression force that is exerted on the neck in the horizontal axis. The inconsistency of the compression force in the horizontal axis may cause the neck to twist. Conventional truss rods may not be able to counter the twisting effect.

A need exists for a stringed musical instrument neck that overcomes the disadvantages of prior art necks.

SUMMARY OF THE INVENTION

It is an object of the invention to provide a neck for a stringed musical instrument that is easier to manufacture than prior art necks.

It is another object of the invention to provide a neck comprised of components that may be easily removed and replaced.

One aspect of the invention is a neck for a stringed musical instrument. The neck may comprise a generally longitudinal center support member, a fingerboard fixed to a first surface of the center support member, and a string mounting member. The center support member may be fixed at one end to the string mounting member and fixed at an opposite end to a body of the stringed musical instrument The neck may include a generally longitudinal tension adjustment member that is not the same member as the center support member. The tension adjustment member may be fixed at one end to the string mounting member and fixed at an opposite end to the body of the stringed musical instrument. The tension adjustment member is adjustable to vary stress on the neck.

A generally longitudinal spatial volume may be located between the center support member and the tension adjustment member. A majority of the spatial volume may comprise ambient air.

The longitudinal axis of the tension adjustment member and the longitudinal axis of the center support member may define a single plane that is substantially perpendicular to the top surface of the fingerboard.

The neck may further comprise second and third generally longitudinal tension adjustment members having first ends fixed to the string mounting member and opposite ends fixed to the body of the stringed musical instrument. The second and third tension adjustment members may be adjustable to vary stress on the neck.

The neck may include second and third generally longitudinal spatial volumes located between the second tension adjustment member and an adjacent longitudinal member, and the third tension adjustment member and an adjacent longitudinal member, respectively. Majorities of the second and third spatial volumes may comprise ambient air.

Another aspect of the invention is a method of making a neck for a stringed musical instrument, comprising fixing a plurality of longitudinal members between an instrument body and a string mounting member. The spatial volumes between adjacent longitudinal members may comprise primarily ambient air.

The method may further comprise attaching a fingerboard to one of the plurality of longitudinal members.

A further aspect of the invention is a neck for a stringed musical instrument, comprising a string mounting member; a plurality of longitudinal members fixed between an instrument body and the string mounting member; a plurality of longitudinal spatial volumes located between adjacent longitudinal members, the spatial volumes comprising primarily ambient air; and a fingerboard fixed to one of the plurality of longitudinal members.

One of the plurality of longitudinal members may be a center support member. The fingerboard may be fixed to the center support member. One of the plurality of longitudinal members may be a tension adjustment member.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

A neck for a stringed musical instrument may offer a great deal of sound variability because of its components and its method of construction. The neck may be fabricated from generally available material stock. The neck may include a generally longitudinal central support member. The central support member may have a constant or variable cross-sectional shape, may be solid or hollow, or solid at some cross-sections and hollow at others, and may comprise a single material or a combination of materials. A fingerboard may be fixed to a surface of the central support member.

The neck may include at least one generally longitudinal tension adjustment member. The tension adjustment member may be adjusted to oppose a bowing force in the neck. Additional tension adjustment members may be provided. The tension adjustment members may have a constant or variable cross-sectional shape, may be solid or hollow, or solid at some cross-sections and hollow at others, and may comprise a single material or a combination of materials.

Optionally, at least one generally longitudinal member referred to as a "neck profile member" may provide a comfortable surface to engage the instrument player's hand. One or more of the tension adjustment members may also function as neck profile members. The neck profile members may have a constant or variable cross-sectional shape, may be solid or hollow, or solid at some cross-sections and hollow at others, and may comprise a single material or a combination of materials.

In some embodiments, one or more transverse support members may provide stiffness or rigidity to one or more of the central support member, the tension adjustment member or members, and the neck profile member or members.

Figure 1:
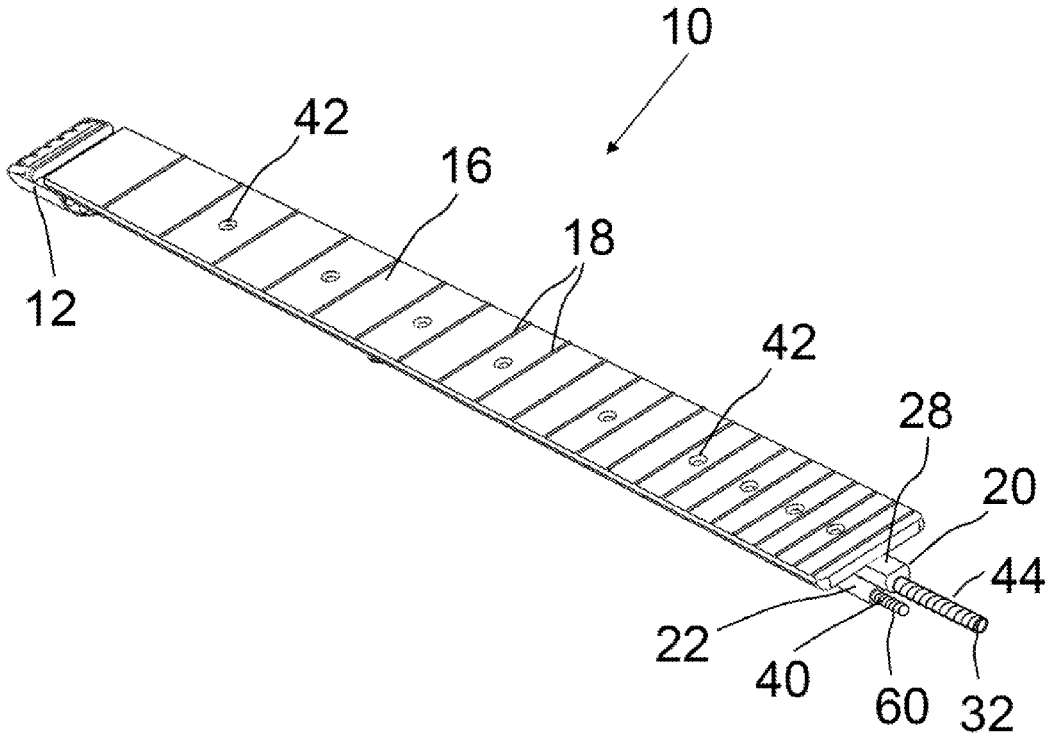
FIG. 1 is a perspective view of one embodiment a neck in accordance with the invention.
Figure 2:
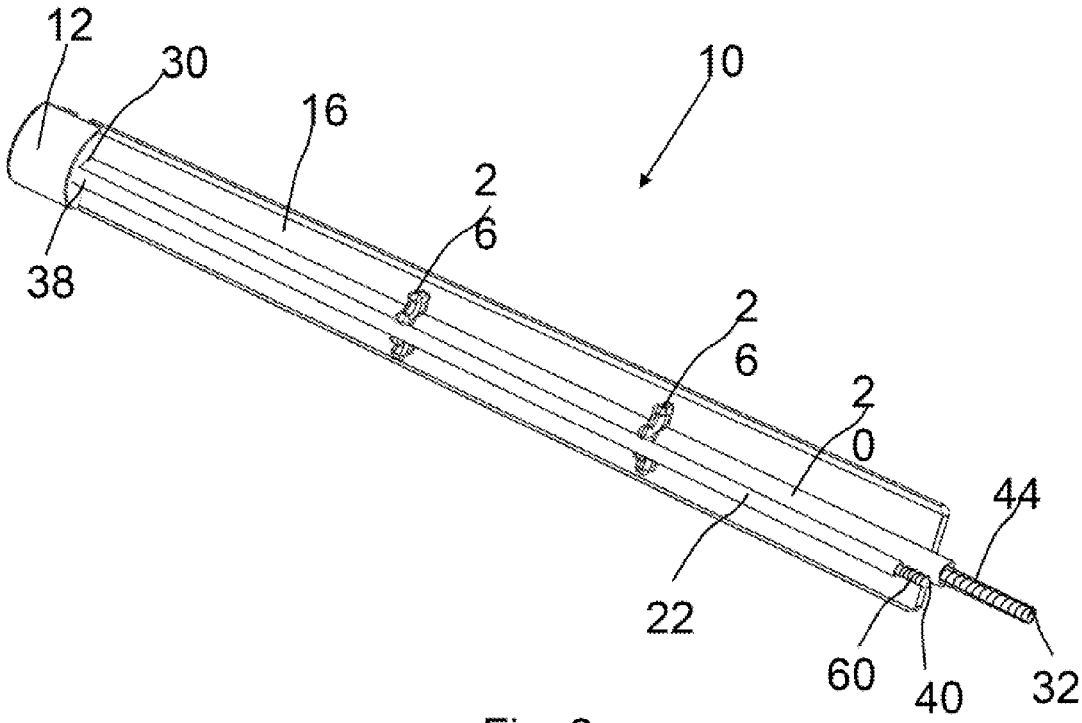
FIG. 2 is a perspective view of the underside of the neck of FIG. 1.
Figure 3:
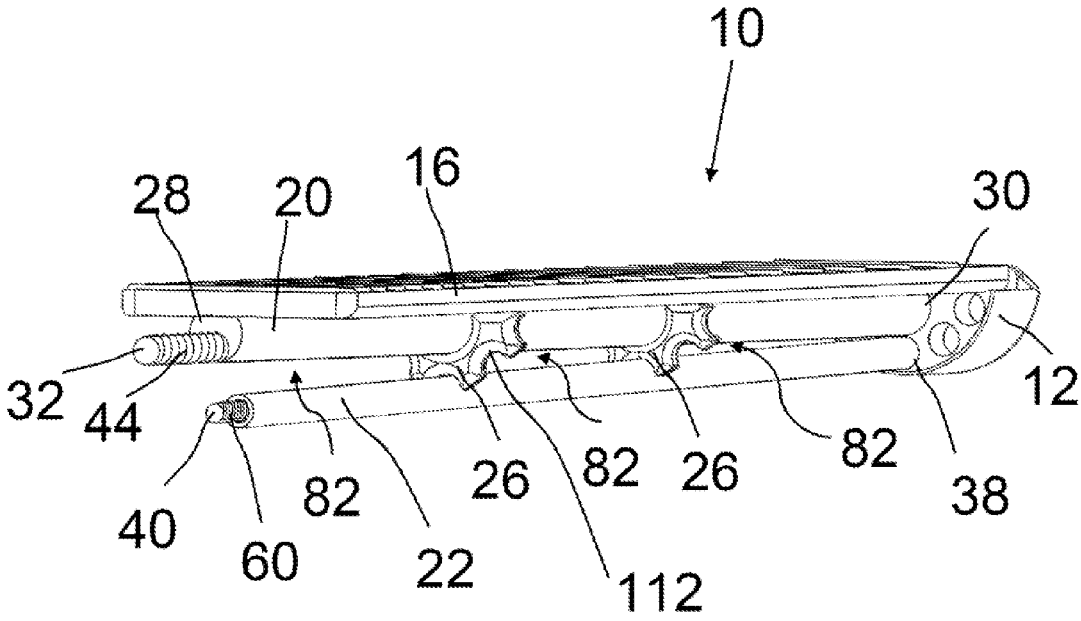
FIG. 3 is a perspective side view of the neck of FIG. 1.
Figure 8:
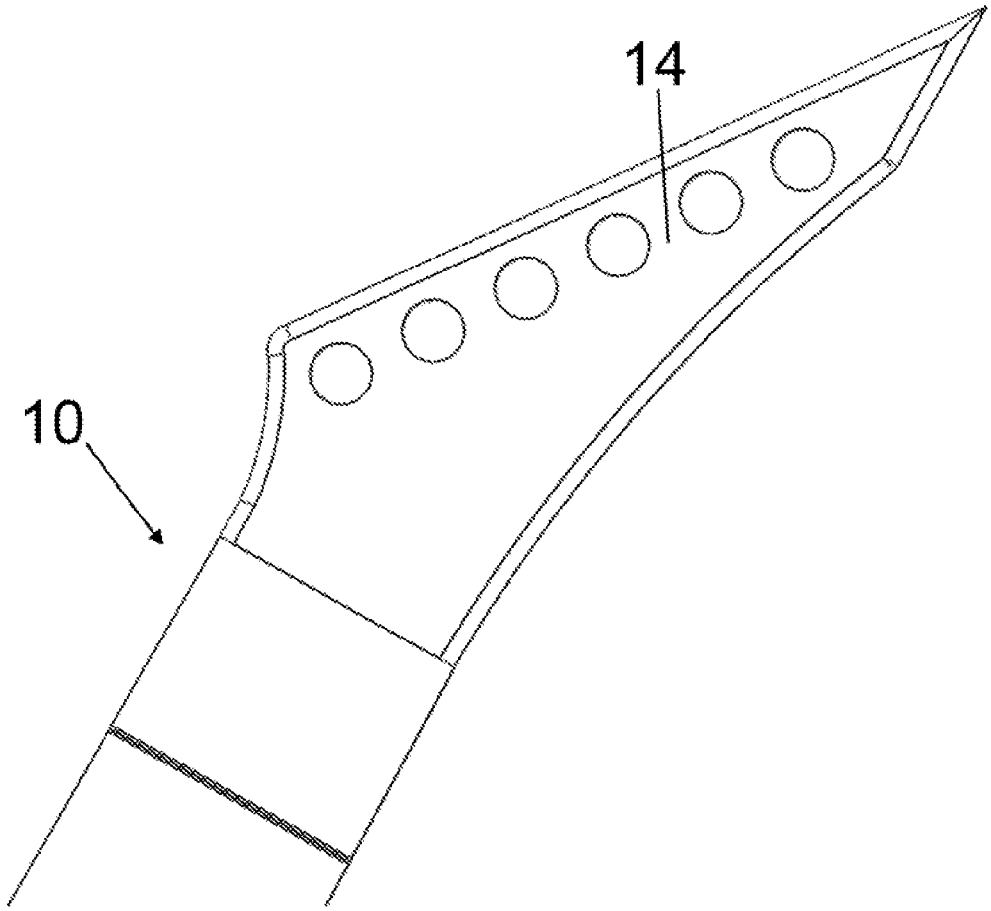
FIG. 8 is a side view of a string support member in the form of a peg head.

FIG. 1 is a perspective view of one embodiment a neck 10 in accordance with the invention. FIG. 2 shows the underside of FIG. 1 and FIG. 3 is a side view of FIG. 1. Neck 10 may include a generally longitudinal center support member 20, a fingerboard 16 fixed to a first surface 28 of the center support member 20, and a string mounting member 12. In FIGS. 1-3, the string mounting member 12 is shown as a string block. However, string mounting member 12 may alternatively be a peg head 14 (FIG. 8).

Central support member 20 may comprise, by way of example, an aluminum rod with a machined surface 28. Fingerboard 16 (FIG. 1) may include frets 18, or may be unfretted. By way of example, fingerboard 16 may be fixed to surface 28 of center support member 20 with mechanical fasteners 42. Fingerboard 16 may comprise, for example, wood. String mounting member 12 may comprise, for example, aluminum. For clarity, the strings of the stringed musical instrument are not shown in FIGS. 1-3.

Figure 4:
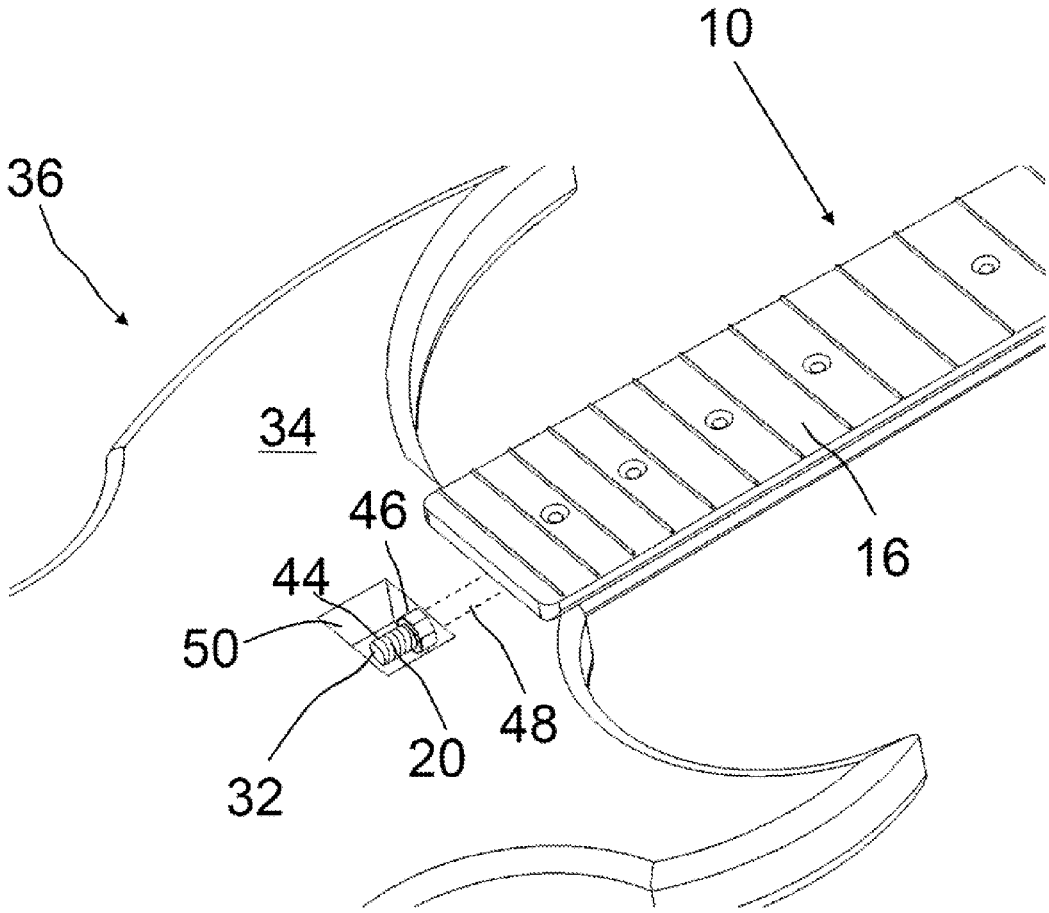
FIG. 4 illustrates an exemplary manner of fixing a center support member to an instrument body.

Center support member 20 may be fixed at one end 30 to the string mounting member 12 and fixed at an opposite end 32 to a body 34 (FIG. 4) of a stringed musical instrument 36. FIG. 4 shows an exemplary method of fixing the center support member 20 to the instrument body 36. End 32 of center support member 20 may be guided through an opening 48 in body 36. Via an access opening 50 in body 36, a nut 46 may be threaded onto threads 44 of end 32 to secure the center support member 20 to the body 36. It should be noted that nut 46 is not used to adjust the tension in neck 10, but rather to fix member 20 to body 36.

Figure 5:
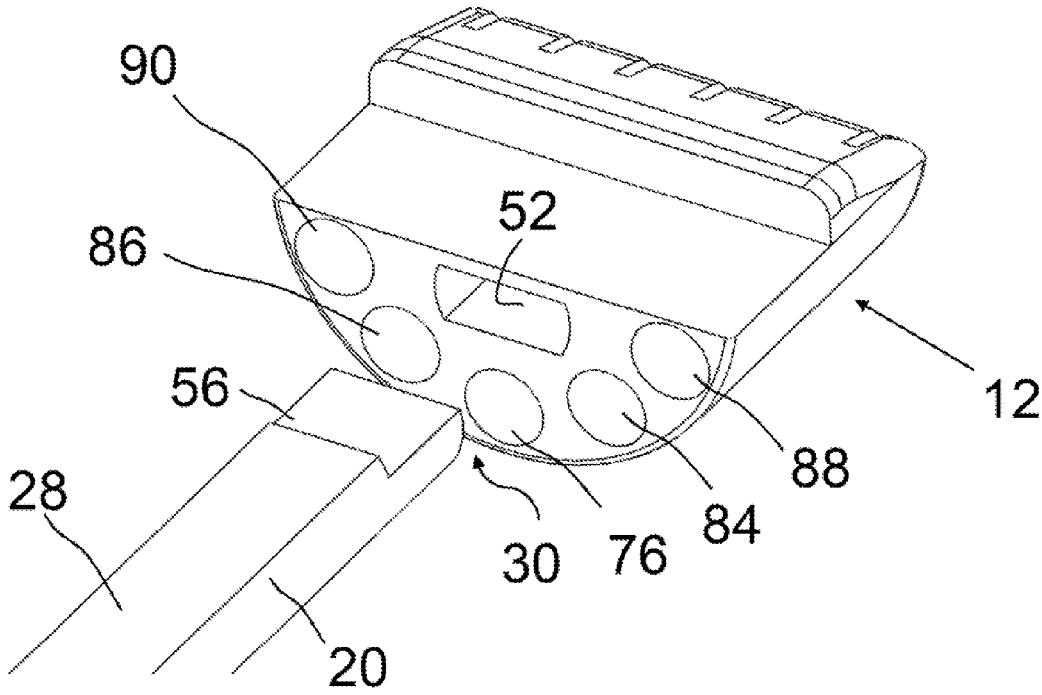
FIGS. 5 and 6 illustrate an exemplary manner of fixing a center support member to a string mounting member.
Figure 6:
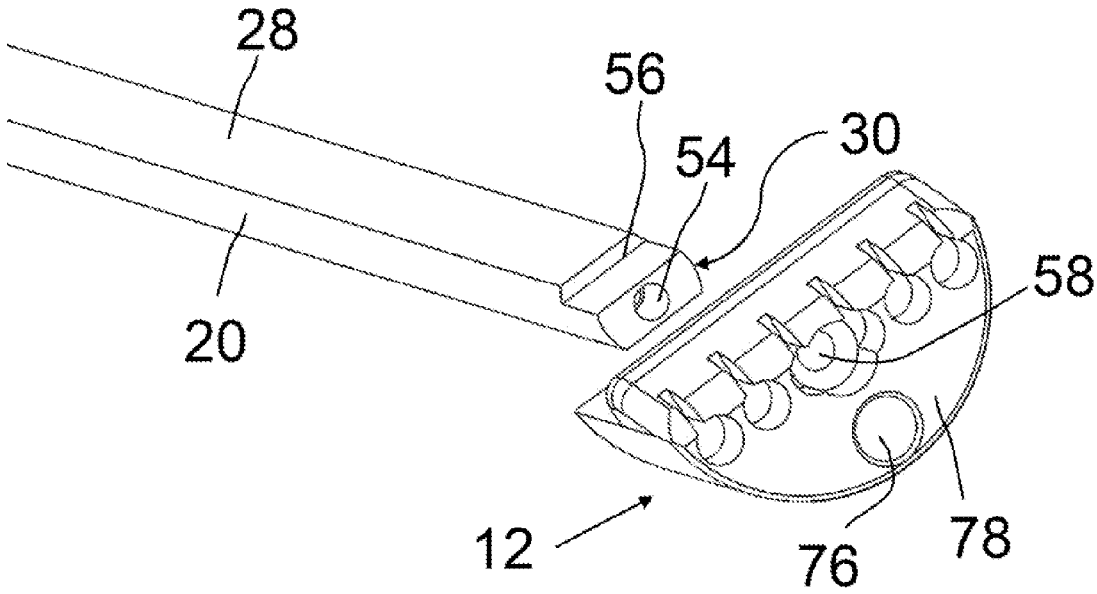

FIGS. 5 and 6 illustrate an exemplary manner of fixing the center support member 20 to the string mounting member 12. End 30 of member 20 may include a stepped portion 56 that abuts string mounting member 12 when end 30 of member 20 is inserted in opening 52 in string mounting member 12. Opening 52 in member 12 may not extend completely through member 12. On the opposite side of member 12 from opening 52, a fastener opening 58 is provided for inserting a fastener (not shown) into the fastener opening 54 in the end 30 of member 20. Other methods may also be used to secure center support member 20 to string mounting member 12.

Referring again to FIGS. 1-3, neck 10 may include a generally longitudinal tension adjustment member 22. The tension adjustment member 22 is in addition to the center support member 20, that is, the tension adjustment member 22 and the center support member 20 are not the same member. The tension adjustment member 22 is fixed at one end 38 to the string mounting member 12 and fixed at an opposite end 40 to the body 34 of the stringed musical instrument 36. The tension adjustment member 22 is adjustable to vary stress on the neck 10.

Figure 7:
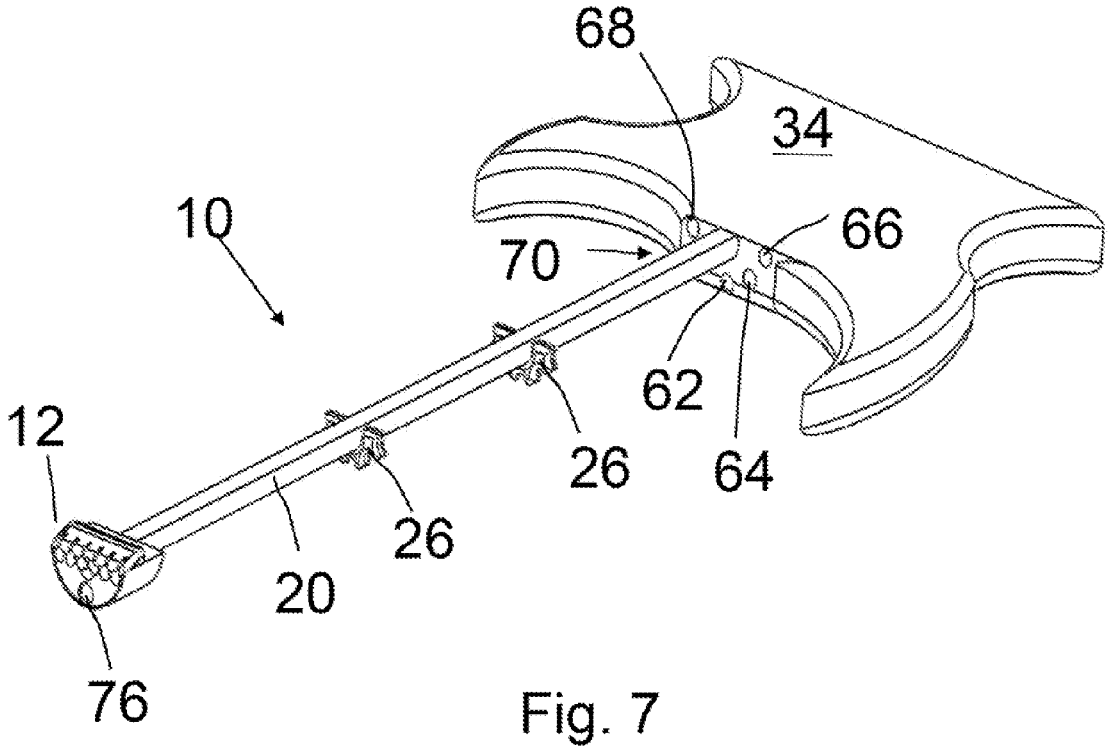
FIG. 7 is a perspective view of a stringed musical instrument showing openings in the instrument body for receiving longitudinal members of the neck.

End 40 of tension adjustment member 22 may be provided with threads 60. One way to fix tension adjustment member 22 to body 34 is to insert threads 60 of member 22 into a threaded opening 62 (FIG. 7) in body 34. In FIG. 7, only the center support member 20 is shown, so that the openings 62, 64, 66, 68, and 70 in body 34 are visible. Opening 70 is hidden behind member 20, but opening 70 may be positioned such that openings 70 and 64 are symmetrical with respect to center support member 20.

Figure 9:
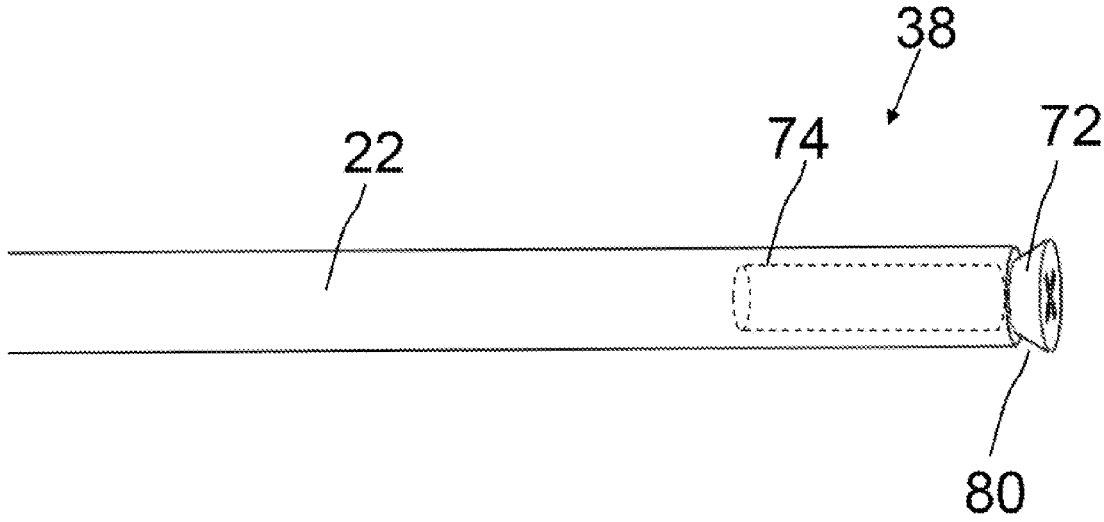
FIG. 9 is a side view of an end of a tension adjustment member that may be fixed to a string support member.

One way to fix tension adjustment member 22 to string support member 12 is shown in FIGS. 5, 6, and 9. FIG. 5 shows the through hole 76 in string support member 12 for receiving end 38 (FIG. 9) of tension adjustment member 22. End 38 may include a threaded opening 74. After end 38 is inserted into hole 76 in string support member 12, fastener 72 (FIG. 9) may be inserted into the outer end 78 of hole 76 and into threaded opening 74 of member 22. The sides 80 of fastener 72 bear against the outer end 78 of hole 76.

After fastener 72 is fully threaded into threaded opening 74, further rotation of fastener 72 causes member 22 to thread into opening 62 (FIG. 7) of instrument body 34. As fastener 72 is rotated, tension adjustment member 22 may apply a bending force to neck 10 that is opposite from the bending force due to the strings of the musical instrument.

In contrast to prior art necks, neck 10 may not be a generally solid structure. That is, the center support member 20 and tension adjustment member 22 are not encased in a generally solid neck structure. Rather, as seen in FIG. 3, a generally longitudinal spatial volume 82 is defined between the center support member 20 and the tension adjustment member 22. A majority of the spatial volume 82 may comprise ambient air. In many embodiments, substantially all of the spatial volume 82 may comprise ambient air.

As seen in FIGS. 1-3, the tension adjustment member 22 may be disposed on an opposite side of the center support member 20 from the fingerboard 16. If only a single tension adjustment member 22 is used, then the single member 22 is disposed substantially as shown in FIGS. 1-3. That is, a longitudinal plane that substantially bisects and is perpendicular to fingerboard 16 may contain both the longitudinal axis of the tension adjustment member 22 and the longitudinal axis of the center support member 20.

Figure 10:
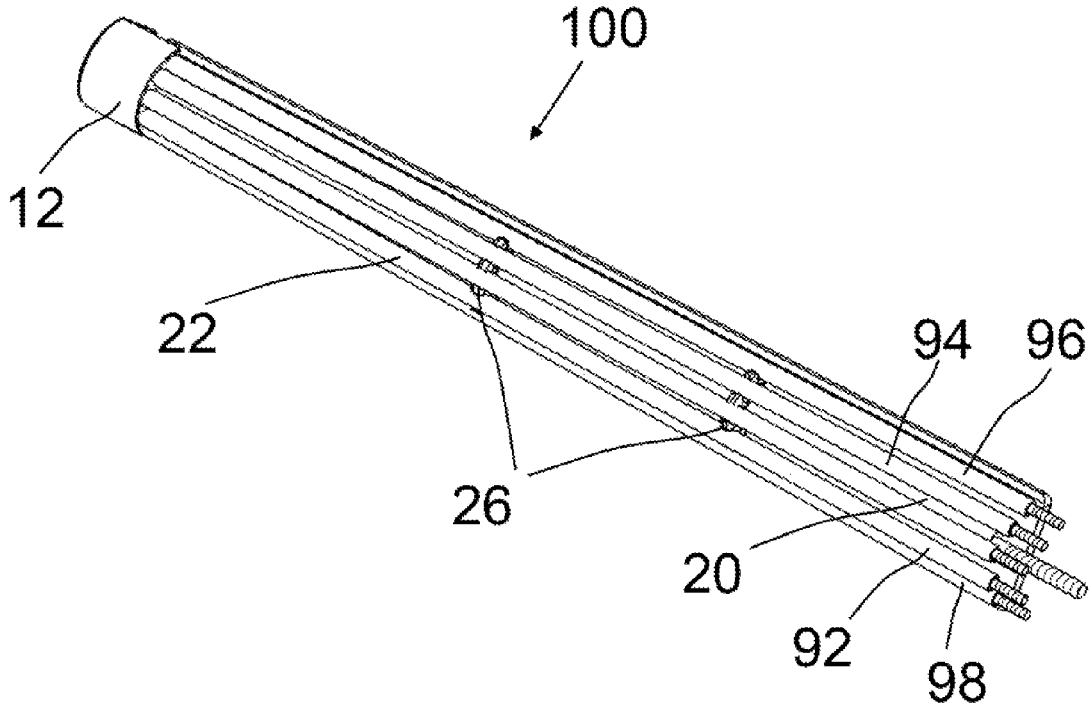
FIG. 10 is a perspective view of the underside of a neck with multiple tension adjustment members.

Additional tension adjustment members identical or similar to member 22 may be used. These members may be fixed to the string support member 12 through openings 84, 86, 88 and 90 (FIG. 5), and to the body 34 through openings 64, 66, 68 and 70 (FIG. 7), in the same manner as tension adjustment member 22. FIG. 10 shows a neck 100 with five tension adjustment members 22, 92, 94, 96, and 98. Each of the five tension adjustment members 22, 92, 94, 96, and 98 are adjustable to vary stress on the neck. More than five tension adjustment members may be used. Tension adjustment members 22, 92, 94, 96, and 98 may comprise, for example, carbon fiber.

In some embodiments, tension adjustment member 22 is the only tension adjustment member. In other embodiments, tension adjustment member 22 may be used with one pair of additional tension adjustment members 92 and 94, or 96 and 98, or both pairs of additional tension adjustment members 92, 94 and 96, 98, or further pairs of tension adjustment members (not shown). One or both pairs of additional tension adjustment members 92, 94 and 96, 98 may be used without tension adjustment member 22. Each pair of tension adjustment members 92, 94 and 96, 98 may be arranged symmetrically with respect to the center support member 20.

As described with reference to tension adjustment member 22, a majority of each of the respective longitudinal spatial volumes defined between each of the additional tension adjustment members 92, 94, 96, and 98 and an adjacent longitudinal member comprises ambient air.

As seen in FIG. 10, the outer surfaces of the tension adjustment members 22, 92, 94, 96 and 98 may provide a contact area for the instrument player's hand. The cross-section of each of the tension adjustment members 22, 92, 94, 96 and 98 shown in FIG. 10 is circular. However, other geometries may be used and the geometry may vary from member to member or along the same member. Circular geometries may be preferable for creating symmetrical stresses in neck 10, and for providing a comfortable contact area for the instrument player's hand.

Figure 11:
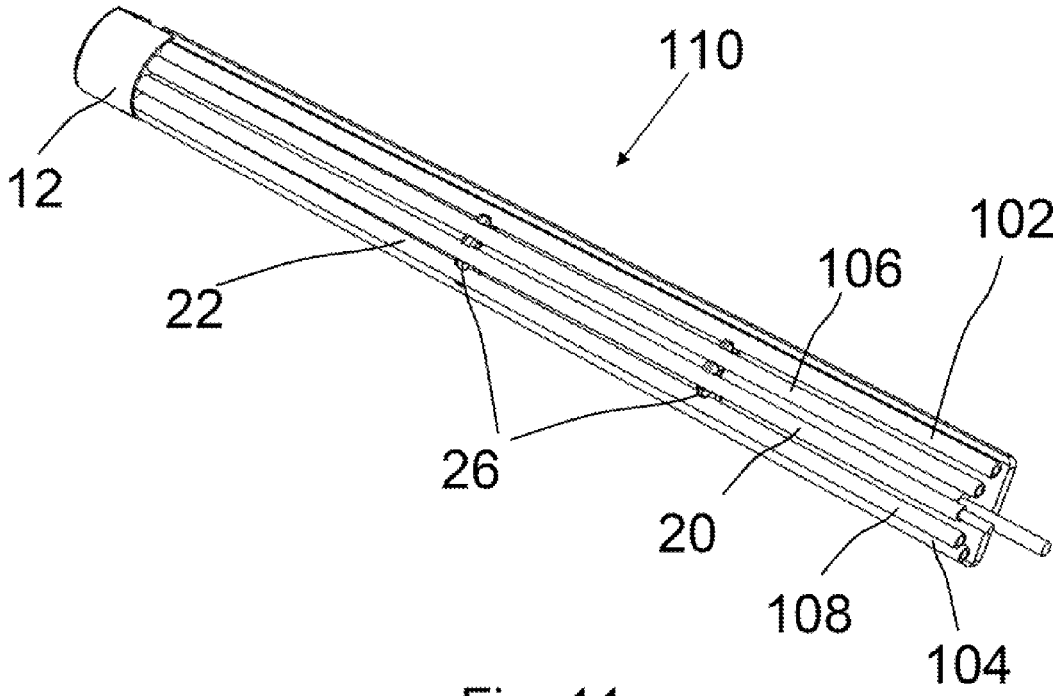
FIG. 11 is a perspective view of the underside of a neck with multiple neck profile members.

In addition to the tension adjustment members 22, 92, 94, 96 and 98, or in lieu of one or more of the tension adjustment members 22, 92, 94, 96 and 98, neck 10 may include one or more generally longitudinal neck profile members extending from the string mounting member 12 to the body 34 of the stringed musical instrument. FIG. 11 shows a neck 110 with multiple longitudinal neck profile members 102, 104, 106, 108. The function of neck profile members 102, 104, 106, 108 is to create one or more surfaces that provide a comfortable contact area for the instrument player's hand.

The cross-section of each of the neck profile members 102, 104, 106, 108 shown in FIG. 11 is circular. However, other geometries may be used and the geometry may vary from member to member or along the same member. Circular geometries may be preferable for providing a comfortable contact area for the instrument player's hand. Neck profile members 102, 104, 106, 108 may be arranged substantially symmetrically with respect to the center support member 20.

Because the neck profile members 102, 104, 106, 108 are not used to adjust tension in the neck, the neck profile members may be fixed to the body 34 and the string mounting member 12 with more ease compared to the tension adjustment members. For example, the neck profile members may simply fit snugly in openings in the body 34, for example, openings 62, 64, 66, 68 and 70 shown in FIG. 7. At the other end, the neck profile members may simply fit snugly in openings in the string mounting member 12, such as openings 76, 84, 86, 88, and 90 shown in FIG. 5. The neck profile members 102, 104, 106, 108 may comprise, for example, carbon fiber.

As described with reference to the tension adjustment members, a majority of each of the respective longitudinal spatial volumes defined between each of the neck profile members 102, 104, 106, 108 and an adjacent longitudinal member comprises ambient air.

Figure 12:
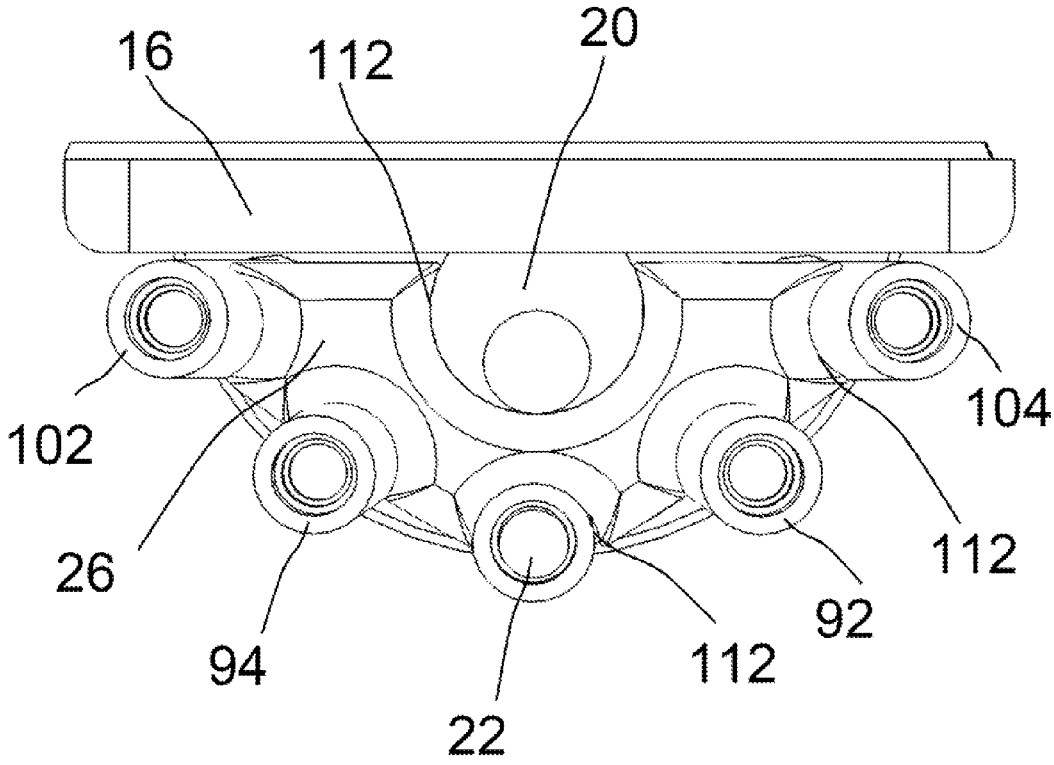
FIG. 12 is an enlarged view of a transverse member taken along a cross-section of the neck.

As seen in FIGS. 2, 3, 7, 10 and 11, one or more transverse support members 26 may be provided to help support one or more of the central support member 20, tension adjustment members 22, 92, 94, 96, 98, and neck profile members 102, 104, 106, 108. FIG. 12 shows an enlarged view of transverse support member 26 with a center support member 20, tension adjustment members 22, 92, 94, and neck profile members 102, 104. The various longitudinal members may be disposed in cutouts 112 (best seen in FIG. 3) provided in transverse members 26. Transverse support members 26 may prevent flexing of the longitudinal members when the instrument player squeezes the neck while playing the instrument. Transverse support members 26 may comprise, for example, plastic.

The neck may be assembled using conventional fasteners with conventional hand tools. Assembling the neck does not require the highly specialized skills needed to fabricate prior art necks.

The fingerboard 16 may be suspended from its centerline on the center support member 20. The fingerboard 16 alone is much less massive than an entire neck. The string vibrations may be transferred though the center support member 20 and provide the excitement needed to vibrate the fingerboard 16. This excitement may cause the fingerboard 16 to vibrate freely and produce a sound unlike conventional necks. Additionally, the longitudinal members that may form the neck are light enough so that the string vibrations may be transferred through them, thereby offering unique vibration and audible characteristics that are unlike prior art necks.

The inventive neck is modular in nature. The modularity may allow the end user (player) to substitute different fingerboards 16, center support members 20, tension adjustment members 22, 92, 94, 96, 98, and neck profile members 102, 104, 106, 108 made of varying materials. Substituting materials with different densities in the structure of the neck may alter the overall density of the neck, which may affect the way the sound waves travel through the neck structure. Higher frequencies may be amplified by using denser materials for the members. Lower frequencies may be enhanced by using less dense materials for the members. A combination of material densities may result in frequency responses that appeal to different users.

The inventive neck may provide the comfort of a neck thru design, with the benefits of a bolt-on design. The use of multiple tension adjustment members may allow one to counter the stress imparted to the neck by the strings. Also, twisting effects that may be present may be countered by adjusting the tension adjustment members located on either side of the center line of the center support member 20.

Manufacturers may produce varying neck profiles by simply varying the pattern of the holes (in which the longitudinal members fit) on the instrument body and the string mounting member. The varying neck profiles may accommodate a multitude of players, without the need for specialized equipment or workforce. Thus, the inventive neck may be fabricated in a modular fashion using readily available material stock. The end user may customize the sound and feel of the neck by substituting different longitudinal members.

In addition, instrument designers may have more freedom to experiment with new body shapes and neckjoints, due to the manner of attaching the neck to the body. Because the neck may only require small holes for mating with the body, the neck may be more comfortable to play at the neck to body interface.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A neck for a stringed musical instrument, comprising:

a generally longitudinal center support member;

a fingerboard suspended from a first surface of the center support member;

a string mounting member, the center support member being fixed at one end to the string mounting member and fixed at an opposite end to a body of the stringed musical instrument;

a generally longitudinal tension adjustment member that is not a same member as the center support member, the tension adjustment member being fixed at one end to the string mounting member and fixed at an opposite end to the body of the stringed musical instrument, the tension adjustment member being adjustable to vary stress on the neck, the tension adjustment member including an outer surface that is a contact area for a hand of a player of the stringed musical instrument; and a generally longitudinal spatial volume located between the center support member and the tension adjustment member, wherein a majority of the spatial volume comprises ambient air.

2. The neck of claim 1, wherein the string mounting member is a peg head.

3. The neck of claim 1, wherein the string mounting member is a string block.

4. The neck of claim 1, wherein the tension adjustment member is disposed on an opposite side of the center support member from the fingerboard.

5. The neck of claim 4, wherein a longitudinal axis of the tension adjustment member and a longitudinal axis of the center support member define a single plane that is substantially perpendicular to a top surface of the fingerboard.

6. The neck of claim 1, further comprising second and third generally longitudinal tension adjustment members having first ends fixed to the string mounting member and opposite ends fixed to the body of the stringed musical instrument, wherein the second and third tension adjustment members are adjustable to vary stress on the neck.

7. The neck of claim 6, further comprising second and third generally longitudinal spatial volumes located between the second tension adjustment member and an adjacent longitudinal member, and the third tension adjustment member and an adjacent longitudinal member, respectively, wherein majorities of the second and third spatial volumes comprise ambient air.

8. The neck of claim 6, wherein the second and third tension adjustment members are arranged symmetrically with respect to the center support member.

9. The neck of claim 1, further comprising a second generally longitudinal tension adjustment member having a first end fixed to the string mounting member and an opposite end fixed to the body of the stringed musical instrument, wherein the second tension adjustment member is adjustable to vary stress on the neck.

10. The neck of claim 9, wherein the tension adjustment member and the second tension adjustment member are arranged substantially symmetrically with respect to the center support member.

11. The neck of claim 1, further comprising at least one generally longitudinal neck profile member extending from the string mounting member to the body of the stringed musical instrument.

12. The neck of claim 11, further comprising at least one additional generally longitudinal spatial volume located between the at least one neck profile member and an adjacent longitudinal member, wherein a majority of the at least one additional spatial volume comprises ambient air.

13. The neck of claim 11, wherein the at least one generally longitudinal neck profile member comprises a plurality of neck profile members arranged substantially symmetrically with respect to the center support member.

14. The neck of claim 11, wherein the at least one generally longitudinal neck profile member is not adjustable to vary stress on the neck.

15. The neck of claim 1, further comprising at least one transverse support member that engages at least one of the center support member and the tension adjustment member.

16. A method of making a neck for a stringed musical instrument, comprising:

fixing a plurality of longitudinal members between an instrument body and a string mounting member, wherein spatial volumes between adjacent longitudinal members comprise primarily ambient air; and suspending a fingerboard from one of the plurality of longitudinal members.

17. A neck for a stringed musical instrument, comprising:

a string mounting member;

a plurality of longitudinal members fixed between an instrument body and the string mounting member;

a plurality of longitudinal spatial volumes located between adjacent longitudinal members, the spatial volumes comprising primarily ambient air; and a fingerboard suspended from one of the plurality of longitudinal members.

18. The neck of claim 17, wherein one of the plurality of longitudinal members is a center support member and the fingerboard is suspended on the center support member.

19. The neck of claim 18, wherein one of the plurality of longitudinal members is a tension adjustment member.

* * * * *